United States Patent [19]

Johnson

[11] Patent Number: 4,497,154

[45] Date of Patent: Feb. 5, 1985

[54] METHOD OF CONSTRUCTING AND ASSEMBLING BUILDING ELEMENTS FOR FOLDABLY CONSTRUCTED STADIUMS

[76] Inventor: Delp W. Johnson, 240 Oakview Dr., San Carlos, Calif. 94070

[21] Appl. No.: 437,812

[22] Filed: Dec. 17, 1982

[51] Int. Cl.[3] ..... E04G 21/00; E04H 3/10

[52] U.S. Cl. ..... 52/745; 52/6

[58] Field of Search ..... 52/6–10, 52/745, 69, 122.1, 71, 126.1, 126.5; 108/132, 1, 9, 99

[56] References Cited

U.S. PATENT DOCUMENTS 3,494,092 2/1970 Johnson ..... 52/745

FOREIGN PATENT DOCUMENTS 1506480 12/1967 France ..... 108/1

*Primary Examiner*—John E. Murtagh

*Assistant Examiner*—Kathryn L. Ford

[57] ABSTRACT

The invention concerns the method of constructing and assembling the component structural elements for stadiums and the like structures, in which method the elements are assembled in overlying layers over the foundation for the structure, with hinged connections between the elements, and lifting certain of these elements, permits gravity to cause the other elements to rotate downward where the lower ends are placed on the supportive foundation, and they are secured to provide a rigid structure.

20 Claims, 8 Drawing Figures

FIG. 1
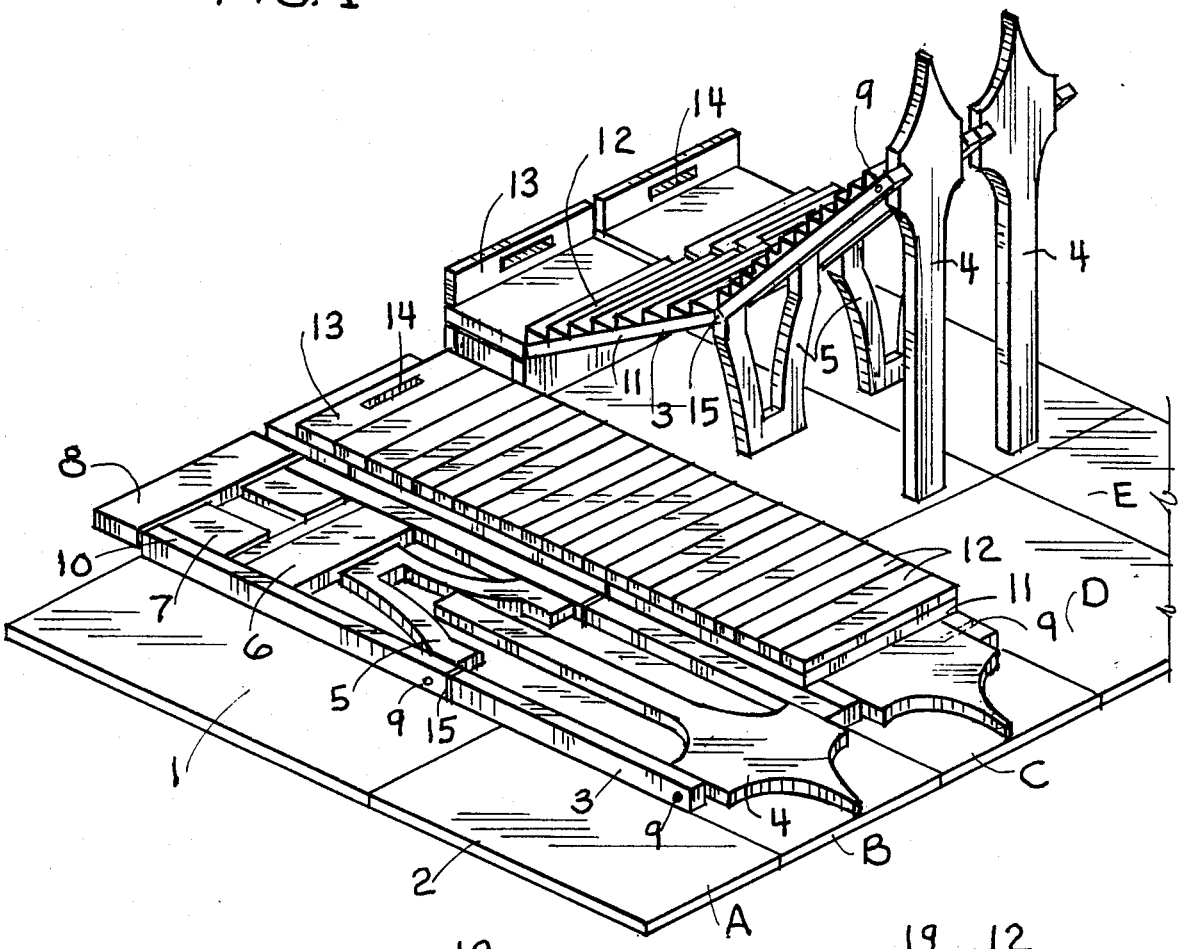
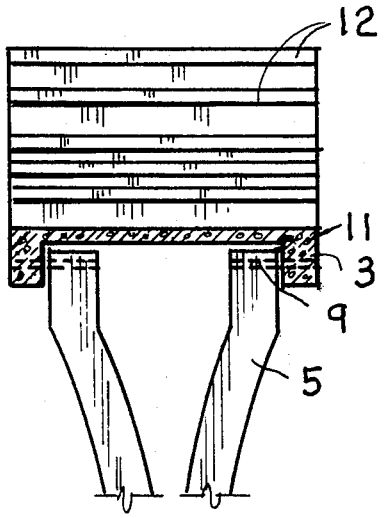
FIG. 2
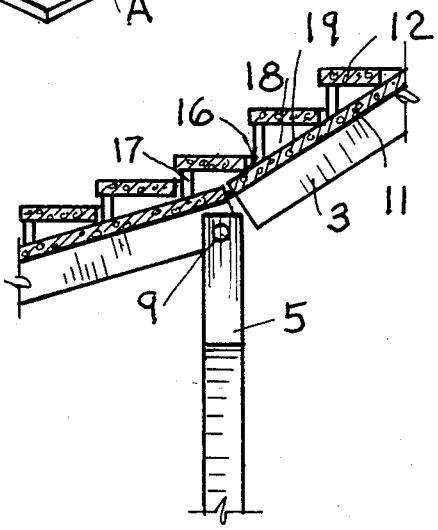
FIG. 3

FIG. 4
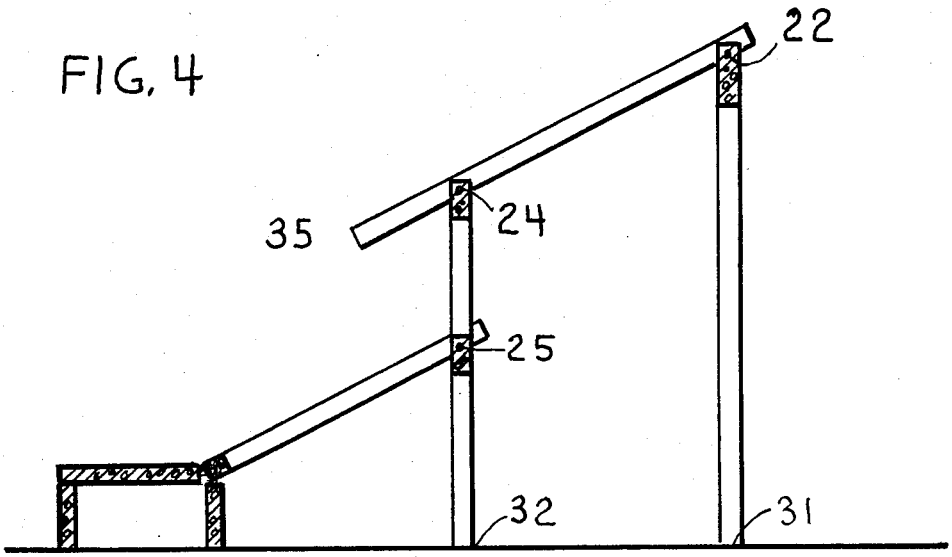
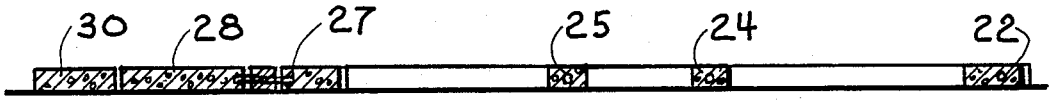
FIG. 5
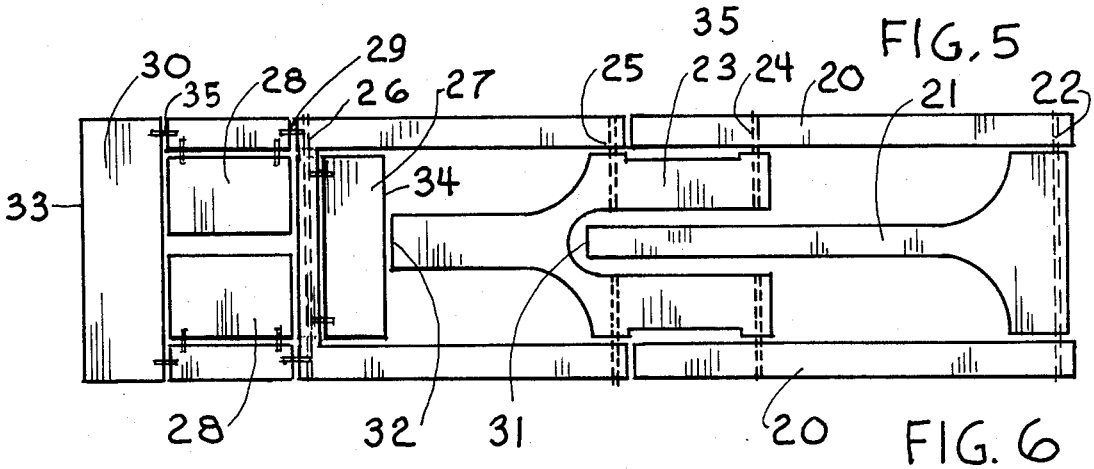
FIG. 6
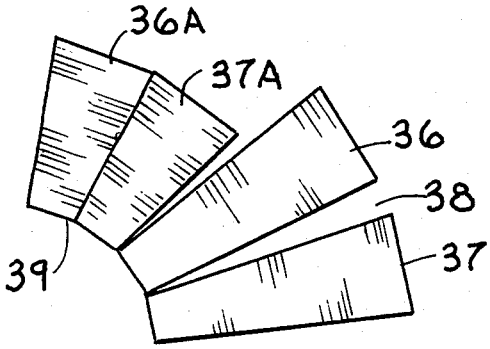
FIG. 7
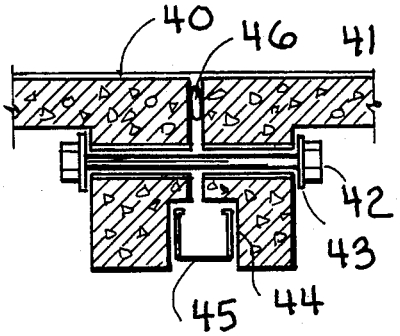
FIG. 8

METHOD OF CONSTRUCTING AND ASSEMBLING BUILDING ELEMENTS FOR FOLDABLY CONSTRUCTED STADIUMS

BACKGROUND

The construction of stadiums is one of the oldest of building arts, and they have been constructed by many methods: including cast in place concrete, brick and masonry, stone, precast concrete, cast iron, and steel. Of special interest is the stadium constructed for the Solano College, California, utilizing the teaching of Johnson U.S. Pat. No. 3,494,092, in which supportive elements were cast extending outward from the deck, and modules so formed were assembled to form alternate modules for the stadium, and then later modules with deck only were placed alternately to complete the structure. The method, at the date in 1971, proved to be the fastest and most economical in competitive bid. The method had the basic disadvantage of requiring transportation of the elements and being limited in the size that could be cast, which made it practical only for small stadiums. Other precast concrete methods have been relatively complex, and quite difficult to bring into proper alignment, to avoid warped and twisted elements, and to make water tight. In addition the structural suitability of the completed structure was difficult to attain.

The present invention bases itself on avoiding these problems and on the current experiences of the inventor in constructing various projects around the world with folding methods.

DESCRIPTION OF THE INVENTION

The basic concept begins with constructing a foundation slab for the entire stadium, and overlying this, constructing a series of modules, each module with an inner end positioned on the inner perimeter of the planned stadium, two sides extending perpendicular to this perimeter and an outer end located parallel to the inner end at the horizontal developed distance from the inner end; and girders are constructed along each of the edges of each module, and the inner ends of the girders are hingeably connected to the inner perimeter of the foundation, and supportive elements are fabricated between the girders, and hingeably connected to the outer portion of said girder lengths, and lifting the outer portion of the girders causes the supportive element to rotate downward to a position where the lower end of the rotated element is supported on the foundation, and it is secured to form a rigid structure. The present invention discloses methods of constructing the girders and the underlying supportive elements to produce the desired slopes for stadiums and the means of preassembling the required structural parts. There is disclosed a new and novel arrangement for constructing "wishbone" columns, and the method of constructing discontinuous decks for stepped stadiums. In addition, there is disclosed the arrangement for forming the modules to form segmentally curved stadiums.

Thus, an entire stadium may be precast in a preassembled position for a stadium of any shape, in which all the parts are prefit together, and lifting the modules one by one, brings them into alignment with the adjacent module, where adjacent decks may be secured together, and the vertical supportive elements secured to the foundation to complete a total structure. In addition, the method provides a great deal of freedom for the designer so that extremely handsome stadiums are possible and economical. It has been estimated that this method can save up to 25% of the structural cost for a comparable size stadium and save up to 30% in construction time. Other advantages will become apparent from the drawings.

DESCRIPTION OF THE DRAWINGS

FIG. 1, shows the foundation slab; the underlying girders and supportive elements; a completed module ready to lift; and two modules erected.

FIG. 2, and FIG. 3, show detail of a section of girder and pivot connection.

FIGS. 4, 5, and 6, show the arrangement for discontinuous deck in plan and section for a tiered stadium.

FIG. 7. shows the plan arrangement of modules around a curve.

FIG. 8. shows the detail for placing a gutter between adjacent modules.

DETAIL DESCRIPTION OF THE DRAWINGS

Referring to FIG. 1, the foundation slab 1, and an extension of a casting bed 2, is shown. The casting bed is required to provide for the developed length of the module in the flat. This casting bed may be developed as a walkway around the finished stadium if desired.

In module B, the side girders 3, are shown defining edges of the module, with supportive elements 4,5,6,7, cast between, and the supportive element 8 extending outward beyond the inner perimeter of the stadium foundation. Pivot connections 9, hingeably attach the girders to the supportive elements. The girders are divided by hinged joint 15 into an inner and outer portion.

Module C, is shown with a slab 11, cast over the underlying girders 3, and supportive element 4. In the preferred practice, this slab and the underlying girders would be cast monolithic. A series of planks 12 are cast overlying slab 11. Each of these planks is hingeably connected to slab 11, at the upper edge of the plank. A front wall 13, for the module, is shown in cast position with hinges at the inner edge. Hole 14 represents one of the possible design elements for the wall, which could be modeled or prefinished as desired while in the flat.

Modules D and E are shown erected with the girders elevated to a compound slope, and the supportive elements 4, and 5 rotated to the vertical and supportive position. Walls 6,7, and 8 have rotated down to form a rigid box element to provide lateral support for the deck 11, which is hingeably secured thereto. Seats 12, have been pivoted up to level position, and there secured. Wall 13, has been rotated up to a vertical position.

Module E is shown erected and connected to Module D, and the elements 4 of each module working together to provide structural support around the perimeter of the stadium. The horizontal decks that would be part of the completed stadium, have been omitted for clarity of the illustration. In addition, the thickness of the slab has been exaggerated for clarity. The shape of the element 4, at the top end is arbitrary and may be shaped to the designer's fancy. In addition, the lower configuration, which for element 4, is shown nested together in module B, may be modified as long as the structural integrity is maintained.

In FIG. 2, girders 3, are shown cast together with slab 11, and a pivot connection 9, providing the hinged connection to 5. Steps 12 are shown in elevation.

FIG. 3, shows the cross section and shows the division of the girder to provide the changing slope. It should be noted that this permits the approximation of the ideal curve for viewing angles for a stadium or amphitheater, which is here very easy to accomplish. The filler block 17, varies according to the steepness of the slope and is locked into position by the back edge of the next ahead tread. The actual seats would be applied later and would be of traditional type, wood, metal, plastic, or aluminum. If desired, heating pipes could pass thru void 18, or the voids could be used for passing warm air, which would give great comfort to a stadium theater. Hinges 16, secure the treads to the slab. In addition, a waterproof membrane, may be applied to the surface 19, and the embedded hinged element to provide a waterproof deck and protection from the weather.

FIG. 6 shows the plan arrangement of a discontinuous slab or girder arrangement. Side girders 20 are pivotally connected to the supportive element 21, by pivot 22. Pivot 22 may comprise a continuous tube thru which a post tensioned cable may be threaded to tie the entire stadium together. Item 23 shows a next supportive element with a pivot 24 connecting the supportive element to one portion of the girder, and a pivot 25, connecting the supportive element to the other portion of the side girder. The action of this arrangement is seen in FIG. 4, where the rotation of the supportive element serves to elevate a portion of the deck to a higher position, thus forming an upper tier. By selecting the length of 21, and 23, and 27, the specific slopes of the decks can be determined for the best viewing angle. In the preferred method of erecting the module, the inner end of the module would first be erected and walls 27,28,38 rotated to vertical, and secured to the foundation. The back portion of the stadium would then be elevated and ends 31, and 32, of the supportive elements brought into supportive position and secured to the foundation.

FIG. 8, shows one means of securing adjacent modules together with bolts threaded thru pivot tubes provided thru the girders 3. These tubes could be in position during the casting over a common core, so alignment is assured.

FIG. 8 also shows one form of gutter 45, which could be inserted between the sides of the girders. An expansive material 46, or a resilient material in the space, could complete the seal. Surface 48 would be covered with a waterproof membrane.

FIG. 7. shows two modules in the horizontal projected position, 36 and 37, with the gap 38, between them in this position. When the modules are elevated, the gap 38 would be eliminated and they could come together as 36A, and 37A. Since the sides of 38 are straight for each slope of the deck, and the width of the deck at the change of slope is mathematically determinable, there is no problem in forming a perfect fit.

IN CONCLUSION

From the above description, the invention has been disclosed to be a very simple method for achieving dramatic results in a new and novel way. In this disclosure, the use of concrete has been emphasized as the preferred material. However, the same general geometric configurations are attainable in steel and wood, and the invention should be considered applicable to the other materials, to the degree that they may comply with fire codes, earthquake codes and the like.

Details of specific hardware have been disclosed in other patents and patent applications of the present inventor, or are in his library as trade secrets.

In summary, it is believed that a new and novel method is disclosed for the construction of stadiums and the like, in a more efficient, economical, faster, better way, than any method known to the inventor. The fact that stadiums are currently being constructed by the old systems by the industry would make it seem that the subject material is not obvious to the practicioners of the art.

I claim:

1. Method of constructing and assembling a modular stadium having an inner and an outer perimeter, comprising the steps of constructing in situ a foundation for said stadium; constructing over said foundation a series of modules having side edges and inner and outer ends, each of said modules disposed along the inner perimeter of said stadium, the side edges of each of said modules disposed along lines originating at the center of curvature of said inner perimeter, and the inner end of said module coincident with said inner perimeter, and the outer end of said module a distance away equal to the developed length of said side edges measured along said side edges, and the length of the outer end of said module equal to the length between said side edges measured at the said outer perimeter of said stadium; and constructing a girder having inner and outer ends along each side of each module, with the inner ends of said girders secured by hinges to the foundation; constructing at least one supportive element between said girders pivotally connected to said girders; length of said supportive element equal to the erected height of the girders at said pivot connection of the supportive element; elevating said outer ends of said girders causing rotation due to gravity of said supportive element to a supportive position; and securing said supportive element on said foundation; whereby, said girders are secured in an inclined position.

2. According to claim 1, adding a parting membrane over the supportive elements, and casting a deck slab over said parting membrane, said deck slab cast integrally with said girders, and said deck slab extending to the ends and edges of said module.

3. According to claim 1, adding at least one change of slope line in said module, said change of slope line located parallel to said inner perimeter, and said change of slope line dividing said module into at least two parts, an inner part and at least one outer part; and installing a hinge connection at said change of slope line connecting said inner part to said outer part; and providing at least one supportive element to each of said parts, and at least one of said supportive elements near said change of slope line, and one of said supportive elements near the outer end of said outer part; and the lengths of said supportive elements equal to the height of said side girders at the location of said pivot connections between said supportive elements and said girders in the erected position, and elevating said module at said change of slope line and at said outer end, and causing rotation due to gravity of said supportive elements to a supportive position; and securing said supportive elements on said foundation; whereby said inner and outer parts of said module are secured in different inclined positions.

4. According to claim 2, adding a parting membrane on top of said deck slab; casting on top of said parting membrane a layer of planks, each of said planks having two ends and an inner and outer edge, said edges arranged parallel to said inner perimeter; and hingeably connecting each of said outer edges of said planks to said deck slab; and elevating said inner edge of each of said planks to a position to form an angle with said deck slab, said angle equal to the slope angle of said deck in the elevated stadium; and installing a means of support under each plank and securing each of said planks in said position; whereby each of said planks is secured in a horizontal position in the elevated stadium.

5. According to claim 4, adding means of heating in the voids under said planks.

6. According to claim 1, adding an anchor means between the edges of adjacent modules, and utilizing said anchor means to secure adjacent modules together in the elevated position.

7. According to claim 1, dividing each module into at least two sections along a tier line parallel to said inner perimeter, an inner section, and at least one outer section, to provide a tiered stadium, and constructing between said side girders of said sections, and extending across said tier line, a special supportive element; said special supportive element pivotally connected to the outer ends of girders of said inner section, and in addition pivotally connected at a distance from said tier line, to the girders of said outer section; and said distance equal to the vertical distance between tiers of the elevated stadium, and elevating the sections of the module causing rotation due to gravity of the special supportive element to a supportive position; and securing said special supportive element to said foundation, whereby said sections are supported in separate tiers, with outer section substantially above outer end of said inner section.

8. According to claim 1, adding an extension of the outer supportive element a distance beyond the outer ends of the side girders; and elevating the module causing rotation due to gravity of the supportive element to a supportive position; whereby the said extension of the outer supportive element extends above the outer end of the stadium module.

9. According to claim 1, installing precast treads and risers across module on top of said girders, and securing said precast treads and risers to said girders, whereby a deck is constructed of said precast treads and risers.

10. According to claim 1, and constructing said perimeter lines as a series of straight segments between said side edges of said modules.

11. According to claim 2, and installing metal seat supports to said deck.

12. Method of constructing and assembling a modular stadium having an inner and an outer perimeter, comprising the steps of: constructing in situ a foundation for said stadium; constructing over said foundation a series of modules having side edges and inner and outer ends, each of said modules disposed along the inner perimeter of said stadium, the side edges of each of said modules disposed along lines originating from the center of curvature of said inner perimeter, and the inner end of said module coincident with said inner perimeter, and the outer end of said module a distance away equal to the developed length of the module along the side edges; and dividing each of said modules into at least two sections by a change of slope line, an inner section and at least one outer section, and each of said sections with inner and outer ends, and side edges; and constructing a girder having inner and outer ends along each side of each section; and for said inner section, constructing four supportive walls of equal height, one of said walls extending inward from said section, and hingeably connecting said wall to said section along the inner perimeter line; the second of said walls extending outward from said section coincident with the change of slope line and hingeably connecting said second wall to said inner section at said change of slope line; the third and fourth of said walls extended from said side girders of said inner module toward each other under said inner section, and hingeably connecting each of said walls to said girders of said inner section, and connecting next outer section hingeably to said inner section along said change of slope line, and constructing at least one supportive element between girders of each outer section, and pivotally connecting each of said supportive elements to said girders; and elevating said inner section causes rotation due to gravity of said supportive walls to a vertical position, and securing said supportive walls to said foundation; whereby said inner section is secured in a horizontal position; and elevating said outer section causing rotation due to gravity of said supportive elements to a supportive position; and securing said supportive elements on said foundation, whereby said section is secured in an inclined position, with its inner end supported on the adjacent section along said change of slope line.

13. According to claim 1, adding at least one set of hollow tubes extending horizontally thru said girders, each of said sets located on a common line parallel to said perimeter line; and installing a continuous cable thru said hollow tubes; and tensioning said cable, whereby said stadium is secured together.

14. Method of constructing and assembling a modular stadium having an inner and an outer perimeter, comprising the steps of: constructing in situ a foundation for said stadium; constructing over said foundation a series of modules having side edges and inner and outer ends, each of said modules disposed along the perimeter of said stadium, the side edges of each of said modules disposed along lines originating at center of curvature of said perimeter, and the inner end of said module conincident with said perimeter and the outer end of said module a distance away equal to the developed length of the deck of said stadium measured along said side edges; and constructing a girder having inner and outer ends along each side edge of said module; and contructing at least one beam between said girders, said beam parallel to said perimeter; and constructing a supportive element between said girders hingeably connected to said beam; elevating said girders causing rotation due to gravity of said supportive elements to a supportive position; securing said supportive element on said foundation; whereby, said girders are in an inclined position.

15. According to claim 1, installing a parting membrane over said supportive elements and casting a riser/tread slab over said membrane, said riser/tread slab cast integrally with said girders, and shaping said riser/tread slab so that treads are in a horizontal position in the elevated position of said stadium.

16. According to claim 1, adding means of waterproofing joint between girders of adjacent modules.

17. According to claim 2, adding a waterproofing membrane over said deck slab.

18. According to claim 1, adding a threaded pivot connection between said supportive elements and said girders, said threaded element of such cross sectional area as required to transfer the loads from the girder to the supportive elements, and providing a space between the face of the supportive element and the face of the girder, said space equal to the take up of the treaded pivot connection, said take up resulting from the rotation of the supportive element from the horizontal to the supportive position.

19. According to claim 1, constructing said supportive elements, each of which has a foot and two upper support points pivotally connected to said girders, and the configuration of said supportive elements is such that the foot of an outer supportive element extends inward past the line of the upper support points of the next inner supportive element; whereby the elevated height of the support points exceeds the distance between the adjacent support points located on the side girders.

20. According to claim 2, and constructing form trenches in said foundation; said trenches aligned in position of said girders, beams and supportive elements, and casting said girders, beams, and supportive elements within said trenches; whereby said form trenches impart a design to the said stadium, and surface between said trenches provides casting bed for said deck.

* * * * *